US012716664B2

(12) United States Patent
Al-Otaibi et al.

(10) Patent No.: US 12,716,664 B2
(45) Date of Patent: Aug. 25, 2026

(54) SUSTAINING COOLING TOWER PERFORMANCE THROUGH AIR SIDE INLET CONDITION CONTROL

(71) Applicant: SAUDI ARABIAN OIL COMPANY, Dhahran (SA)

(72) Inventors: Abdullah M. Al-Otaibi, Dhahran (SA); Ahmad A. Alsaraihi, Jubail (SA); Mustafa K. Hashim, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 501 days.

(21) Appl. No.: 18/336,494

(22) Filed: Jun. 16, 2023

(65) Prior Publication Data

US 2024/0418460 A1 Dec. 19, 2024

(51) Int. Cl.
*F28F 25/12* (2006.01)
*F28F 25/06* (2006.01)

(52) U.S. Cl.
CPC ..... *F28F 25/12* (2013.01); *F28F 25/06* (2013.01)

(58) Field of Classification Search
CPC ..... F28F 25/12; F28F 25/06; F28F 25/10
See application file for complete search history.

(56) References Cited

U.S. PATENT DOCUMENTS 3,923,935 A 12/1975 Cates
4,173,605 A 11/1979 Long
5,088,550 A * 2/1992 Tippman ..... F28F 9/0132 165/125
6,923,250 B2 8/2005 Hegg et al.
7,510,174 B2 3/2009 Kammerzell
8,235,363 B2 8/2012 Samyn et al.
8,899,061 B2 * 12/2014 Reytblat ..... F28C 1/04 62/310

(Continued)

FOREIGN PATENT DOCUMENTS

CN 202041094 U 11/2011
CN 112546799 A 3/2021

(Continued)

OTHER PUBLICATIONS

Bustamante, John G., Alexander S. Rattner and Srinivas S. Garimella. "Achieving near-water-cooled power plant performance with air-cooled condensers." Applied Thermal Engineering 105 (2016): 362-371.

*Primary Examiner* — Devon Lane
(74) *Attorney, Agent, or Firm* — Vorys, Sater, Seymour and Pease LLP

(57) ABSTRACT

A cooling system includes a cooling tower providing a housing that has a bottom, a top opposite the bottom, and a sidewall extending between the top and the bottom, an air intake vent provided on the sidewall and through which external air can enter an interior of the cooling tower, a plurality of louvers arranged at the air intake vent and vertically offset from each other to direct the external air into the interior, and a cooling assembly attached to at least one of the plurality of louvers, the cooling assembly including a tube through which a coolant is circulated and one or more fins extending from a surface of the tube. A temperature and a humidity of the external air is reduced as the external air contacts the cooling assembly while being drawn into the interior through the air intake vent.

18 Claims, 4 Drawing Sheets

(56) References Cited

U.S. PATENT DOCUMENTS

| | | | | |
|---|---|---|---|---|
| 2011/0174003 | A1 | 7/2011 | Wenger | |
| 2012/0305227 | A1* | 12/2012 | Freund | F28F 1/36 165/172 |
| 2017/0051950 | A1* | 2/2017 | Uselton | F25B 49/022 |
| 2020/0278156 | A1* | 9/2020 | D'Arcy | F24F 12/002 |

FOREIGN PATENT DOCUMENTS

| | | | |
|---|---|---|---|
| JP | H08303989 | A | 11/1996 |
| JP | 2020200508 | A | 12/2020 |
| KR | 100283743 | B1 | 2/2001 |
| KR | 101277647 | B1 | 6/2013 |

* cited by examiner

SUSTAINING COOLING TOWER PERFORMANCE THROUGH AIR SIDE INLET CONDITION CONTROL

FIELD OF THE DISCLOSURE

The present disclosure relates generally to cooling tower performance and, more particularly, to cooling assemblies installed on a cooling tower to cool air entering the cooling tower.

BACKGROUND OF THE DISCLOSURE

A cooling tower is a device that rejects waste heat to the atmosphere through the cooling of a coolant stream, usually a water stream, to a lower temperature. Cooling towers may either use the evaporation of water to remove process heat and cool the working fluid to near a wet-bulb air temperature or, in the case of dry cooling towers, rely solely on air to cool the working fluid to near the dry-bulb air temperature using radiators. Cooling towers can be found in power plants, chemical plants, oil refineries, and various manufacturing facilities where heat generation is a byproduct of manufacturing operations.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a cooling system can include a cooling tower providing a housing that has a bottom, a top opposite the bottom, and a sidewall extending between the top and the bottom. The cooling system can include an air intake vent provided on the sidewall and through which external air can enter an interior of the cooling tower. Additionally, the cooling system can include a plurality of louvers arranged at the air intake vent and vertically offset from each other to direct the external air into the interior. The cooling can system can also include a cooling assembly attached to at least one of the plurality of louvers, the cooling assembly including a tube through which a coolant is circulated and one or more fins extending from a surface of the tube. A temperature and a humidity of the external air is reduced as the external air contacts the cooling assembly while drawn into the interior through the air intake vent.

According to another embodiment consistent with the present disclosure, a cooling system can include an air intake vent provided on a sidewall of a cooling tower and through which external air enters an interior of the cooling tower. The air intake vent can include a plurality of vertical supports. The air intake vents can further include a plurality of louvers supported on the plurality of vertical supports and vertically offset from each other, each pair of vertically offset louvers forming a corresponding row. The cooling system can also include a fluid circuit extending within at least one row and including one or more cooling assemblies attached to at least one of the vertically offset louvers, each cooling assembly including a tube through which a coolant is circulated and one or more fins extending from a surface of the tube. Additionally, a temperature and a humidity of the external air is reduced as the external air contacts the one or more cooling assemblies while drawn into the interior through the air intake vent.

According to yet another embodiment consistent with the present disclosure, a method of enhancing cooling of a cooling tower can include drawing external air into an interior of the cooling tower via an air intake vent provided on a sidewall of the cooling tower. The air intake vent can include a plurality of louvers vertically offset from each other to direct the external air into the interior. The air intake vent can also include a cooling assembly attached to at least one of the plurality of louvers, the cooling assembly including a tube and one or more fins extending from a surface of the tube. The method of enhancing cooling of a cooling tower can further include circulating a coolant through the tube and thereby cooling the tube and the one or more fins. Additionally, the method can further include reducing a temperature and a humidity of the external air as the external air contacts the cooling assembly while drawn into the interior through the air intake vent.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
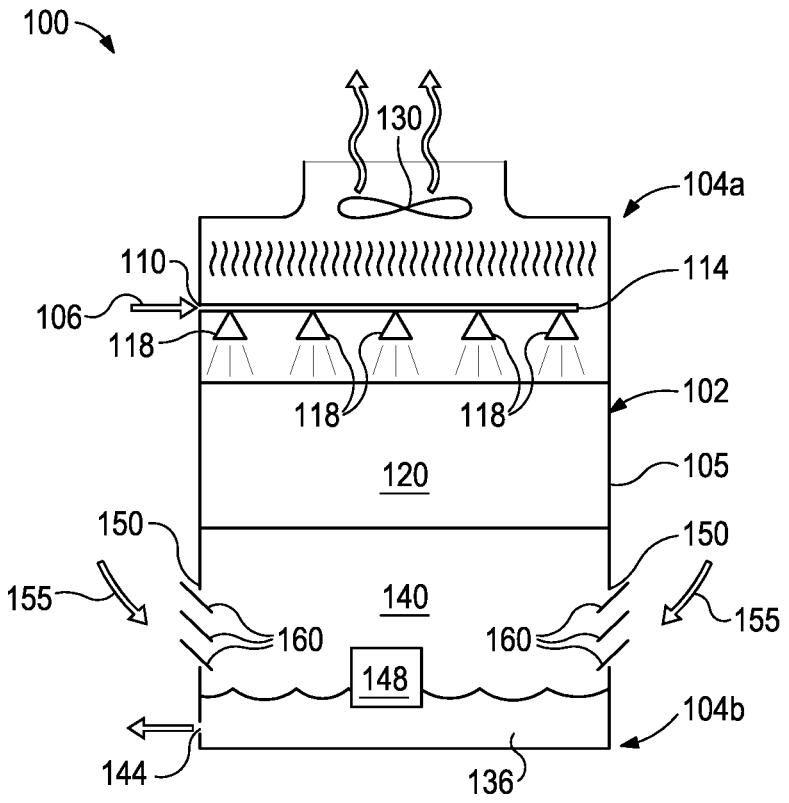
FIG. 1 is a schematic diagram of an example cooling tower.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to cooling tower performance and, more particularly, to cooling assemblies that can be installed on a cooling tower or cooling tower system to cool air entering the cooling tower.

Performance of a cooling tower is based on various factors, including wet bulb temperature. The wet bulb temperature can be measured through evaporative cooling under ambient conditions. For example, wet bulb temperature can be measured with a thermometer with a wetted wick wrapped around its bulb, which simulates evaporative cooling. Accordingly, the wet bulb temperature considers a dry bulb temperature (e.g., air temperature) and humidity of air surrounding the wet bulb. The wet bulb temperature of a cooling tower further represents a lowest temperature that can be achieved by the cooling tower, such that the cooling tower can provide cool water at the wet bulb temperature.

Other factors impacting performance of a cooling tower include a temperature range between hot intake water and cooled output water (e.g., cooling water), a heat load based on process requirements, approach temperature, intake water quality, chemical treatment, and design factors. Design factors of the cooling tower can include cooling capacity, or the amount of heat that needs to be removed from the process or system that relies on the cooling tower. The approach temperature can be the difference between cooled output water temperature and the wet bulb temperature. Because the wet bulb temperature represents a lowest temperature that can be achieved by the cooling tower, the approach temperature indicates efficiency or effectiveness of the cooling tower.

Performance of the cooling tower can be improved by curtailing (decreasing) the wet bulb temperature, as well as the approach temperature. Reducing the wet bulb temperature and approach temperature will correspondingly reduce the air temperature and humidity within the cooling tower, which results in a cooling tower that can cool water below that of conventional cooling towers. As described herein, the air temperature and humidity of air within the cooling tower can be reduced by installing one or more cooling assemblies at an intake vent of the cooling tower where the cooling tower receives external air. The cooling assembly can be installed on louvers to reduce the temperature of the air being drawn into the cooling tower at the intake vent. Furthermore, the cooling assembly can cause water vapor of warm air that passes through the intake vent to condense, thereby producing condensate on the louvers of the cooling tower. Therefore, the cooling assembly can reduce the temperature of air entering the cooling tower, as well as the humidity of the air entering cooling tower. Accordingly, the cooling assembly can curtail the wet bulb temperature by reducing humidity and temperature of air in the cooling tower.

FIG. 1 illustrates an example cooling tower 100 that can incorporate the principles of the present disclosure. The cooling tower 100 can be an evaporative cooling tower that uses the evaporation of water to dissipate waste heat from industrial processes or power generation. As illustrated, the cooling tower 100 includes a housing 102 having a top 104*a*, a bottom 104*b* opposite the top 104*a*, and a sidewall 105 extending between the top and the bottom 104*a,b*. In example operation, hot water 106 can be provided to the cooling tower 100 at or near the top 104*a*, and the cooling tower 100 may be configured to transfer heat from the hot water 106 to the surrounding environment.

More specifically, the cooling tower 100 can receive the hot water 106 at a side inlet 110, which may communicate the hot water 106 to a manifold 114 that feeds the hot water 106 to one or more nozzles 118. The nozzles 118 can be coupled to the manifold 114 at various locations along the length of the manifold 114 and receive the hot water 106 from the manifold 114. The nozzles 118 may be configured to disperse (discharge) the hot water 106 into the interior of the cooling tower 100 to interact with air 155 flowing through the interior of the cooling tower 100. As the air 155 impinges on droplets of the hot water 106, the temperature of the hot water 106 begins to cool by evaporating a portion of the hot water 106.

As illustrated, the hot water 106 discharged from the nozzles 118 can be received by a plurality of compact fill components collectively referred to herein as a "fill" 120. The fill 120 may comprise a heat exchange surface or packing that is configured to spread the hot water 106 across a larger surface area and thereby increase its contact with the air 155 circulating through the cooling tower 100. As the hot water 106 flows onto and descends through the fill 120, heat is exchanged between the hot water 106 and the air 155 flowing in the opposite direction (e.g., upward) through the fill 120. Thus, hot water 106 that circulates through the fill 120 is cooled as heat from the hot water 106 is transferred to the air 155.

In some examples, the compact fill components of the fill 120 can include a film fill, or thin, closely spaced, and patterned sheets. The sheet of a film fill can be formed of a plastic, PVC, or metal, and arranged in a corrugated, honeycomb, or cross-fluted pattern. In other examples, the fill 120 can be a splash fill, or a series of horizontal, vertical or angled bars that are configured to further disperse falling hot water 106 into smaller water droplets.

The top 104*a* of the cooling tower 100 is generally open and includes one or more fans 130 arranged vertically above the nozzles 118. The fan(s) 130 may be operable to pull (draw) the external air 155 into the interior of the cooling tower 100 and through the fill 120, which will eventually bypass the nozzles 118 and manifold 114 before being discharged into the surrounding atmosphere. As the fan 130 pulls the air 155 through the fill 120, heat is exchanged between the hot water 106 and the air 155, such that heated air 155 is discharged from the cooling tower 100 at the top 104*a*. The air 155 heated by the hot water 106 can be replaced by cooler air 155 pulled by the fan 130 through the cooling tower 100 and the fill 120. Thus, air 155 flowing through the fill 120 and the cooling tower 100 can act as a heat sink on the hot water 106 that cools the hot water 106 as it circulates through the fill 120, such that cold (or colder) water 136 is discharged from the bottom of the fill 120.

The cold water 136 can accumulate in a basin 140 provided at or near the bottom 104*b* of the cooling tower 100 below the fill 120. The basin 140 can include an outlet 144 through which the cold water 136 can be conveyed out of the cooling tower 100 and to the plant or another industrial process that may employ the cold water 136. In some embodiments, a wet bulb thermometer 148 may be arranged within the basin 140 and configured to measure the wet bulb temperature within the cooling tower 100, which is the minimum temperature that can be reached by the cold water 136. Particularly, the wet bulb temperature is dependent on humidity and temperature of the surrounding air 155 of the basin 140. That is, higher humidity of the air 155 in the basin 140 results in a relatively higher wet bulb temperature. Conversely, air 155 with less humidity can allow more water to evaporate, resulting in a relatively lower wet bulb temperature.

As previously stated, the fan 130 can pull the air 155 through the fill 120 and eject heated and humid air 155 that has received heat via an evaporative process from the hot water 106. The external air 155 can be drawn into the basin 140 via one or more air entrances or "intake vents" 150 defined in the sidewall 105 of the cooling tower 100 at or near the bottom 104*b*. Because the intake vent 150 is positioned at or near the basin 140, the external air 155 that enters the cooling tower 100 through the intake vent 150 can impact the temperature and humidity of the air 155 in the basin 140, as well as the wet bulb temperature measured by the wet bulb thermometer 148. Therefore, the external air 155 that enters the cooling tower 100 through the intake vent 150 can impact the lowest possible temperature of the cold water 136.

The intake vent 150 can include a plurality of louvers 160, which may comprise horizontal slats or panels vertically offset from each other and operable to direct airflow into the cooling tower 100, as well as prevent water droplets from the fill 120 from escaping the cooling tower 100. The louvers 160 may be designed to provide an even distribution of the air 155 over (into) the fill 120 to promote heat transfer and evaporation, as well as conserve water by preventing water droplets and waterborne contaminants from spreading to the surrounding environment. Additionally, the louvers 160 can prevent external debris, such as dust and insects, from entering the cooling tower 100 and clogging internal components such as the fill 120. Further, the louvers 160 can block direct sunlight to reduce algae growth. Accordingly, the louvers 160 can prevent water from escaping the cooling tower 100 and protect the cold water 136 and air in the basin 140 from experiencing fluctuations in humidity and temperature caused by external factors.

Performance of the cooling tower 100 can be improved by decreasing the wet bulb temperature within the interior of the cooling tower 100, as well as the temperature of the incoming air 155. A lower wet bulb temperature and approach temperature of the incoming air 155 will correspondingly reduce the air temperature and humidity within the cooling tower, which may allow the cooling tower 100 to more efficiently cool the hot water 106. According to embodiments of the present disclosure, one or more cooling assemblies may be provided at the intake vent 150, such as being attached to the louvers 160. As described herein, such cooling assemblies may prove advantageous in reducing the temperature of the air 155 being drawn into the cooling tower 100 at the intake vent 150. Furthermore, the cooling assemblies can cause water vapor of warm air that passes through the intake vent 150 to condense, thereby producing condensate on the louvers 160 of the cooling tower 100. Consequently the cooling assemblies described herein can reduce the temperature and humidity of the air 155 entering the cooling tower 100, which results in a decrease of the wet bulb temperature.

Figure 2:
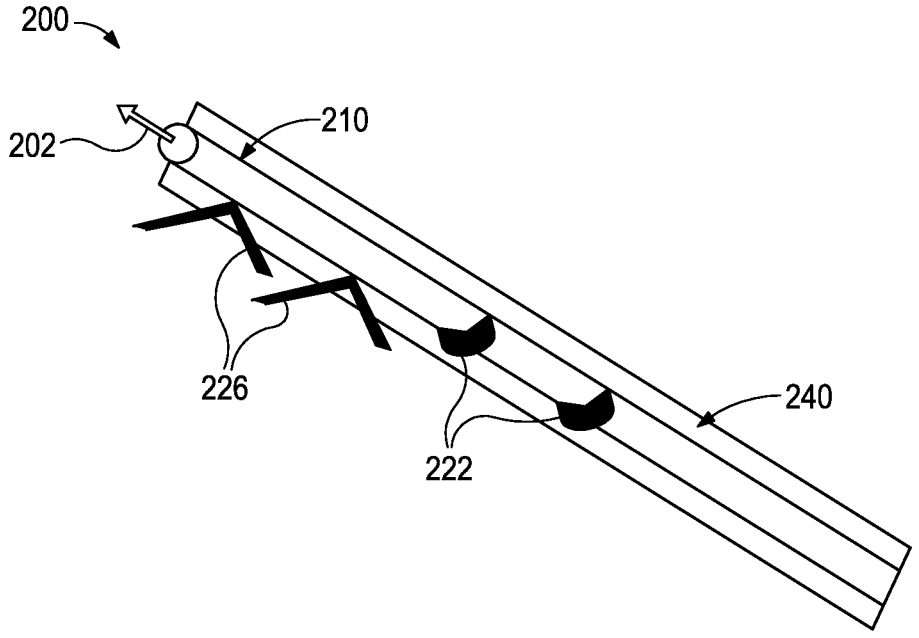
FIG. 2 is a schematic, isometric view of an example cooling assembly, according to one or more embodiments of the present disclosure.

FIG. 2 is an isometric, bottom view of an example cooling assembly 200 that may be used in conjunction with the cooling tower 100 of FIG. 1, according to one or more embodiments. As illustrated, the cooling assembly 200 can include a tube 210 that extends a length of the cooling assembly 200. The tube 210 may comprise a conduit or pipe, and a coolant 202 may be circulated through the interior of the tube 210 to help cool the air 155 (FIG. 1) as it traverses (e.g., flows over) the cooling assembly 200. The coolant 202 may comprise, for example, a cryogenic substance that has a boiling point substantially lower than water. One example of the coolant 202 is liquid nitrogen, which has a boiling point of −196 degrees Celsius (° C.). Other examples of the coolant 202 include, but are not limited to, liquefied natural gas (LNG), propane, butane, ethane, carbon dioxide, or any combination of the foregoing. The tube 210 can be made of a material that can withstand cold temperatures without becoming brittle or experiencing significant thermal expansion or contraction. Example materials for the tube 210 include, but are not limited to aluminum, copper, carbon steel, admiralty brass, aluminum brass, copper-nickel alloy, or stainless steel.

The cooling assembly 200 can further include one or more heat transfer elements or "fins" that extend from a surface (e.g., outer diameter) of the tube 210. The fins effectively increase or extend the surface area of the tube 210 to improve heat transfer, similar to a heat sink. The fins can be positioned at predetermined or random locations along the length of the tube 210 and may exhibit a variety of geometries, without departing from the scope of the disclosure. In the illustrated embodiment, the cooling assembly 200 includes one or more semi-circular fins 222 and one or more array fins 226 positioned along the length of the tube 210. The fins 222, 226 may be made of a variety of rigid materials capable of transferring heat away from the tube 210. Example materials for the fins 222, 226 include, but are not limited to copper and aluminum. In other embodiments, the fins 222, 226 may be made of the same material as the tube 210.

The semi-circular fins 222 may comprise radial extensions of the tube 210, and may be made of the same material as the tube 210. In some embodiments, the semi-circular fins 222 may exhibit a half-circle or semi-circular cross-sectional shape, and may extend about (i.e., encircle) at least a portion of the tube 210. In other embodiments, however, the semi-circular fins 222 may extend about the entire outer circumference of the tube 210, without departing from the scope of the disclosure. As will be appreciated, the semi-circular (arcuate) shape of the semi-circular fins 222 increases the surface area of the tube 210 and also allows the semi-circular fins 222 to conform closely to the outer surfaces of tube 210, which ensures thermal contact with the tube 210 to promote heat transfer. Additionally, the circular shape of the semi-circular fins 222 can promote air flow around the tube 210 by guiding air flow around the tube 210.

The array fins 226 may comprise, for example, smaller diameter pipes or conduits that extend radially outward from the outer surface of the tube 210. In some embodiments, such pipes or conduits may be in fluid communication with the interior of the tube 210 such that the coolant 202 flowing within the tube 210 may also circulate through the pipes or conduits, thereby enhancing the cooling capability of the system. In other embodiments, the pipes or conduits may merely form radial extensions of the tube 210, which also enhances the cooling capability of the system. The array fins 226 may be positioned at predetermined or random locations along the length of the tube 210. In some examples, two or more of the array fins 226 can be attached to the outer surface of the tube 210 in a grid or matrix pattern about all or a portion of the outer circumference of the tube 210, thereby creating multiple channels for air flow around the tube 210. In other examples, the array fins 226 can be arranged radially, staggered, or longitudinally spaced (either equidistantly or non-equidistantly).

While two examples of fins 222, 226 are shown in FIG. 2, those skilled in the art will readily appreciate that other types and designs of the fins 222, 226 may be employed and arranged in different patterns and/or include different types of heat transfer elements, without departing from the scope of the disclosure. The types and arrangement of the fins 222, 226 used in the cooling assembly 200 can be based on a desired arrangement, which can be based on a design factor or arrangement of other cooling assemblies 100 of the same or different cooling tower 100 (FIG. 1).

The fins 222, 226 can be attached to the outer surface of the tube 210. Particularly, the tube 210 can be circular or oval shaped, such that the tube 210 has two hemispheres or semi-circles that define the circumference of the tube. A first hemisphere can correspond to a lower surface of the tube 210, such that the fins 222, 226 can be attached to the tube surface at the first hemisphere or lower surface of the tube 210. In other embodiments, as described in more detail below, the fins 222, 226 can be attached about the entire circumference of the tube 210.

Figure 3:
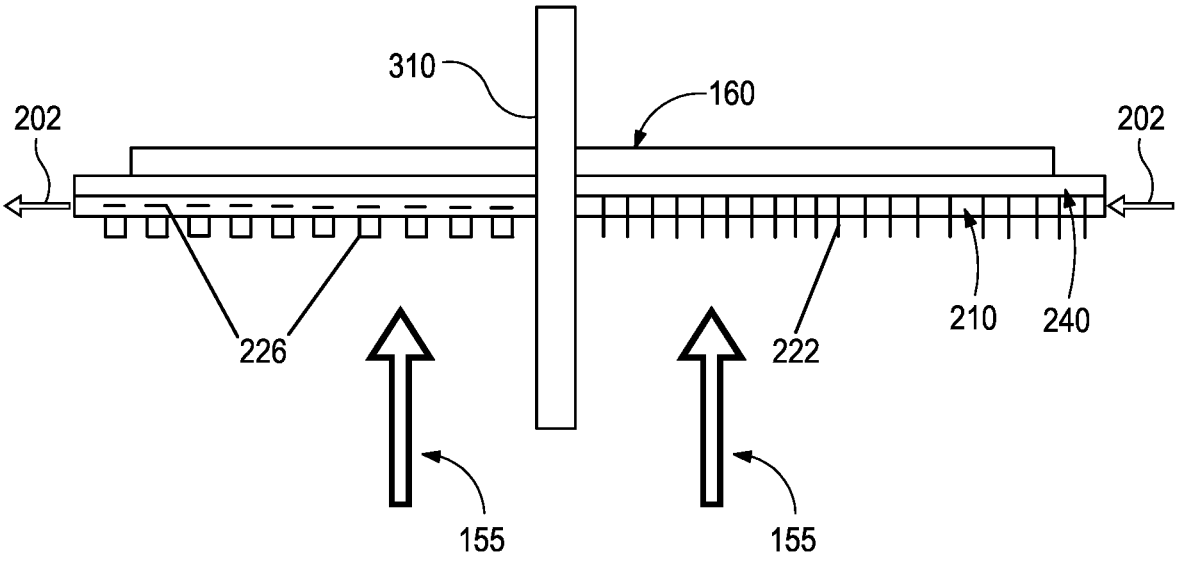
FIG. 3 is a schematic, block diagram of the cooling assembly of FIG. 2 attached to a louver, according to one or more embodiments.

The cooling assembly 200 can further include a pad or "substrate" 240, and the tube 210 may be mounted to the substrate 240. In some embodiments, for example, a second hemisphere or semi-circle of the tube 210 can correspond to an upper surface of the tube 210, the upper surface of the tube being opposite the lower surface of the tube 210. Accordingly, the upper surface of the tube 210 may be mounted to the substrate 240, and the substrate 240 may extend along all or a portion of the length of the tube 210. As illustrated in FIG. 3, the semi-circular fins 222 can extend from the substrate 240 and encircle the tube 210, while allowing a surface of the tube 210 to contact the substrate 240. Similarly, the array fins 226 can be positioned at various positions the tube 210, while allowing the surface of the tube 210 to contact the substrate.

The substrate 240 can be used to fix the cooling assembly 200 to one or more louvers 160 (FIG. 1) of the cooling tower 100 (FIG. 1). The substrate 240 can be made of a variety of materials capable of coupling the cooling assembly 200 to the cooling tower 100. Example materials for the substrate 240 include, but are not limited to, a metal, a plastic, a composite material, an elastomer, or any combination thereof. In other embodiments, however, the substrate 240 may comprise an adhesive or tape configured to facilitate a metal-to-metal attachment, or an attachment of other materials. For example, the substrate 240 can be an epoxy-based adhesive, acrylic adhesive, anaerobic adhesive, structural adhesive tape, and/or a thermal interface substrate capable of fixing the tube 210 to a louver of a cooling tower. In at least one embodiment, the substrate 240 may provide a means to mechanically fasten the cooling assembly 200 to a given louver 160, such as through the use of mechanical fasteners, anchors, brackets, an interference fit, welding, brazing, or any combination thereof. For example, the substrate 240 can be glued or adhered to the louver of the cooling tower and the tube 210 can be clamped to the substrate 240. In at least one other embodiment, the fins 222, 226 can be pivoted or positioned to clamp the tube to the substrate 240.

FIG. 3 is an enlarged, schematic side view of the cooling assembly 200 of FIG. 2 attached to an example louver 160 of the cooling tower 100 of FIG. 1, according to one or more embodiments. As illustrated, the louver 160 may comprise an elongate member or "slat." and may be attached to and otherwise supported by a vertical support 310. The vertical support 310 support and attach the louver 160 to the cooling tower 100 at the intake vent 150 (FIG. 1), for example. In some examples, more than one vertical support 310 can be used to hang the louver 160 and may be arranged at various locations along the length of the louver 160.

In some embodiments, as illustrated, the cooling assembly 200 can be attached to a bottom or bottom surface/side of the louver 160. In such embodiments, the substrate 240 of the cooling assembly 200 can be attached to the bottom of the louver 160 and may thus interpose the bottom of the louver 160 and the tube 210. Therefore, the upper surface of the tube 210 can be attached to the bottom side of the louver 160 via the substrate 240. Accordingly, a lower surface of the tube 210 opposing the upper surface of the tube 210 can also oppose the bottom of the louver 160. Moreover, the fins 222, 226 can be attached to or otherwise extend from the lower surface/side of the tube 210 and also oppose the bottom of the louver 160.

Because the coolant 202 (e.g., liquid nitrogen) flows through the tube 210, exposed surfaces of the tube 210 will be at a substantially lower temperature as compared to the external air 155. In some cases, for example, the external air 155 can be at a temperature ranging between 25 and 50° C., whereas the tube 210 with the coolant 202 flowing therethrough could be at or near −200° C. Particularly, the coolant 202 can have a temperature depending on the type of coolant 202 used, such that liquid nitrogen can have a temperature of −200° C., LNG can have a temperature of −260° C., and propane can have a temperature of −44° C. Moreover, the external air 155 can contain water vapor (e.g., humidity) and, as the external air 155 passes over and impinges upon (contacts) the tube 210, the temperature of the external air 155 may decrease and thereby result in water vapor within the external air 155 condensing onto the external surfaces of the tube 210. In some cases where the coolant 202 is liquid nitrogen, the external air 155 can experience a temperature decrease from about 50° C. to about −200° C. Accordingly, the temperature decrease experienced by the external air 155 is dependent on the type and temperature of the coolant 202.

Accordingly, not only can the cooling assembly 200 reduce the temperature of the external air 155 entering the cooling tower 100 (FIG. 1), but it may also simultaneously remove water vapor from the external air 155 by condensing the water vapor onto the outer surfaces of the tube 210. Consequently, the cooling assembly 200 can reduce the overall humidity of the air 155 drawn into the basin 140 (FIG. 1) of the cooling tower 100. Furthermore, because the louver 160 can be inclined toward the basin 140, any liquid condensate generated by the external air 155 impinging upon the tube 210 can be fed (flowed) into the cold water 136 (FIG. 1) accumulated within the basin 140. Accordingly, arranging the cooling assembly 200 on the louver 160 at the intake vent 150 (FIG. 1) can reduce the wet bulb temperature of the air within the basin 140, thereby lowering the lowest possible temperature of the cold water 136 and improving performance of the cooling tower 100.

While FIG. 3 depicts the cooling assembly 200 being attached to the bottom side of the louver 160, in other embodiments, the cooling assembly 200 may alternatively be attached to the top side of the louver 160. In yet other embodiments, corresponding cooling assemblies 100 can be attached to both the top and bottom sides of the louver 160 without departing from the scope of the disclosure. Those skilled in the art will readily appreciate that positions of the cooling assemblies 100 on the louver 160 can be based on design considerations of the cooling tower 100 (FIG. 1), such as design factor.

Figure 4:
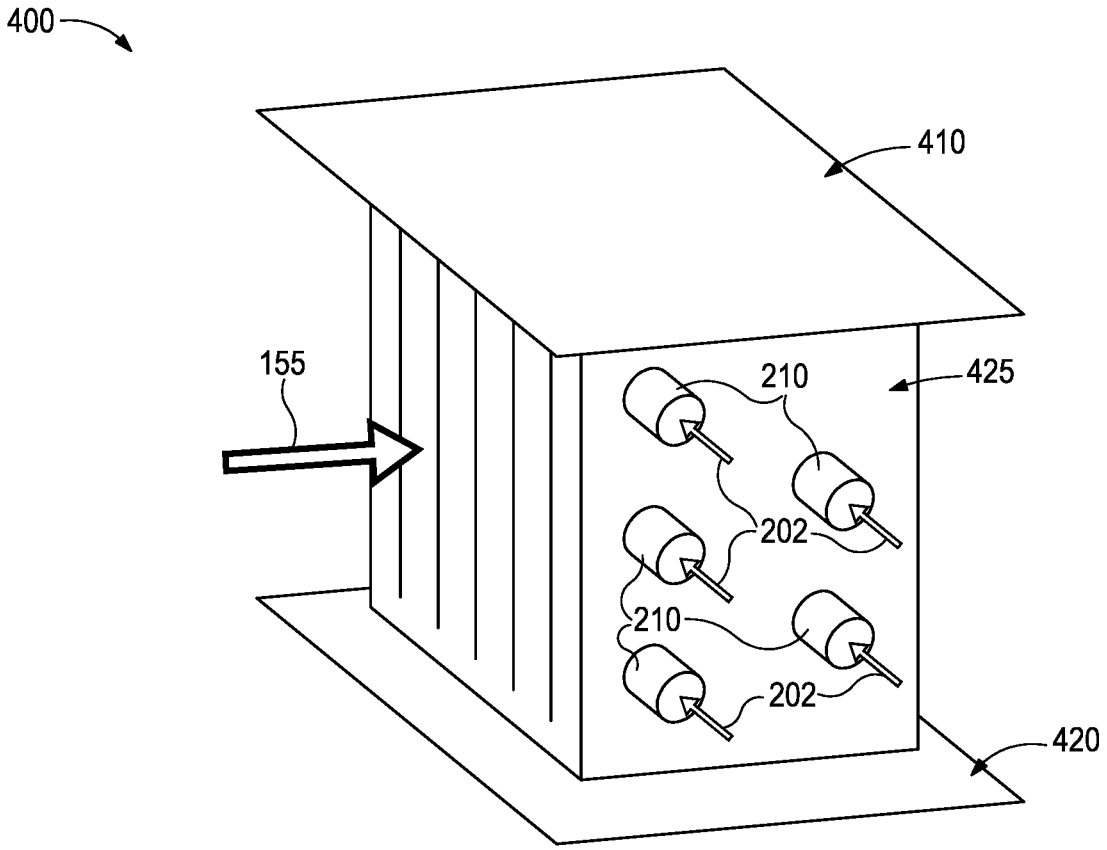
FIG. 4 is a schematic, isometric view of another example cooling assembly, according to one or more additional embodiments of the present disclosure.

FIG. 4 is an isometric, schematic diagram of another example cooling assembly 400, according to one or more additional embodiments. The cooling assembly 400 may be similar in some respects to the cooling assembly 200 of FIG. 2 and, therefore, may be best understood with reference thereto. For example, similar to the cooling assembly 200, the cooling assembly 400 may be used in conjunction with the cooling tower 100 of FIG. 1. As illustrated, the cooling assembly 400 can include a first or "upper" substrate 410 and a second or "lower" substrate 420. The upper and lower substrates 410, 420 may be configured to attach the cooling assembly 400 to vertically adjacent louvers 160 (FIG. 1). In some embodiments, for example, the cooling assembly 400 can be attached to the bottom side of a first louver 160 at the first substrate 410, and further attached to a top side of a vertically-adjacent second louver 160 at the second substrate 420. Accordingly, the cooling assembly 400 may be configured to be arranged and extend between vertically adjacent louvers 160.

The cooling assembly 400 may further include one or more tubes 110 (five shown) extending generally parallel with the upper and lower substrates 410, 420 and one or more fins 425 that extend between the first and second substrates 410, 420. Similar to the fins 222, 226 of FIGS. 2 and 3, the fins 425 may operate as heat transfer elements for the tubes 110, which help decrease the temperature of the external air 155 passing through the fins 425 and impinging upon the outer surfaces of the tubes 110. In some embodiments, as illustrated, the one or more of the tubes 110 may penetrate the fins 425. In such embodiments, the fins 425 may circumscribe the outer surface of the tubes 110 at select locations along the length of the tubes 110. Because the fins 425 extend between the first and second substrates 410, 420, the fins 425 increase the surface area of the tubes 110 more dramatically as compared to the fins 222, 226 of FIGS. 2 and 3, which are attached only to one surface of the given tube 210. The fins 425 can be formed from a material such as copper or aluminum.

As illustrated in FIG. 4, the fins 450 can circumscribe a plurality of tubes 110. Accordingly, the fins 425 can exchange heat between the tubes 110 and the external air 155 flowing over the fins 425 to cool the external air 155 and produce condensate from water vapor in the external air 155. The fins 425 can be arranged in a pattern, such that the fins 425 are arranged as a series of plates along the lengths of the tubes 110. Additionally, or alternatively, the fins 425 can be arranged as an array of fins. The fins 425 may be designed to guide the flow of the external air 155 over (and into contact with) the tubes 110, thereby effectively extending a surface area of the tubes 110. For example, a given fin 425 can circumscribe multiple tubes 110 that have a length that is parallel to an attached louver 160 (FIGS. 1 and 3). The given fin 425 can be arranged perpendicular to the tubes 110, and can have a width that is equal to or similar to a width of the corresponding first substrate 410 and second substrate 420, or a width that is equal to or similar to the first and second louver 160.

In some embodiments, one or more of the fins 425 can be angled or sloped with respect to the lengths of the tubes 110 circumscribed by the fins 425. In operation, the fins 425 may prove advantageous not only in provide greater surface area to the tubes 110, but also guiding air flow, and providing further protection to the cooling tower 100 (FIG. 2) from external factors.

In some embodiments, one or more of the tubes 110 may be arranged in the same plane, which may be perpendicular or parallel to one of the upper or lower louvers 160 (FIGS. 1 and 3) between which the cooling assembly 400 is arranged. In other embodiments, on or more of the tubes 110 may extend in a plane that is non-perpendicular and/or non-parallel to one of the upper or lower louvers 160 between which the cooling assembly 400 is arranged. In yet other embodiments, as depicted in FIG. 4, the tubes 110 can have a staggered arrangement where each tube 210 extends parallel to at least one other tube 210, but none of the tubes 110 are arranged in the same horizontal plane. The arrangement of the plurality of tubes 110 can be based on design factor or arrangements of other cooling assemblies 400 of attached to the cooling tower 100 (FIG. 2).

The coolant 202 flowing within each tube 210 may be referred to herein as a "cold stream." In some embodiments, the coolant 202 flowing in each tube 210 may be the same. In other embodiments, however, one or more first tubes 110 can circulate a first coolant 202, while one or more second tubes 110 can circulate a second coolant 202 different from the first coolant 202. In such embodiments, the first and second coolants 202 can be provided by different sources and may flow to different drains. In other embodiments, one or more first tubes 110 can circulate the coolant 202 in a first direction, while one or more second tubes 110 can circulate the coolant 202 (or a different coolant) in a second direction opposite the first direction. The direction, sources, and drains of the coolant 202 can be based on the design factor of the cooling tower 100 (FIG. 2) and the arrangement of other cooling assemblies 400 attached to the cooling tower 100.

Figure 5:
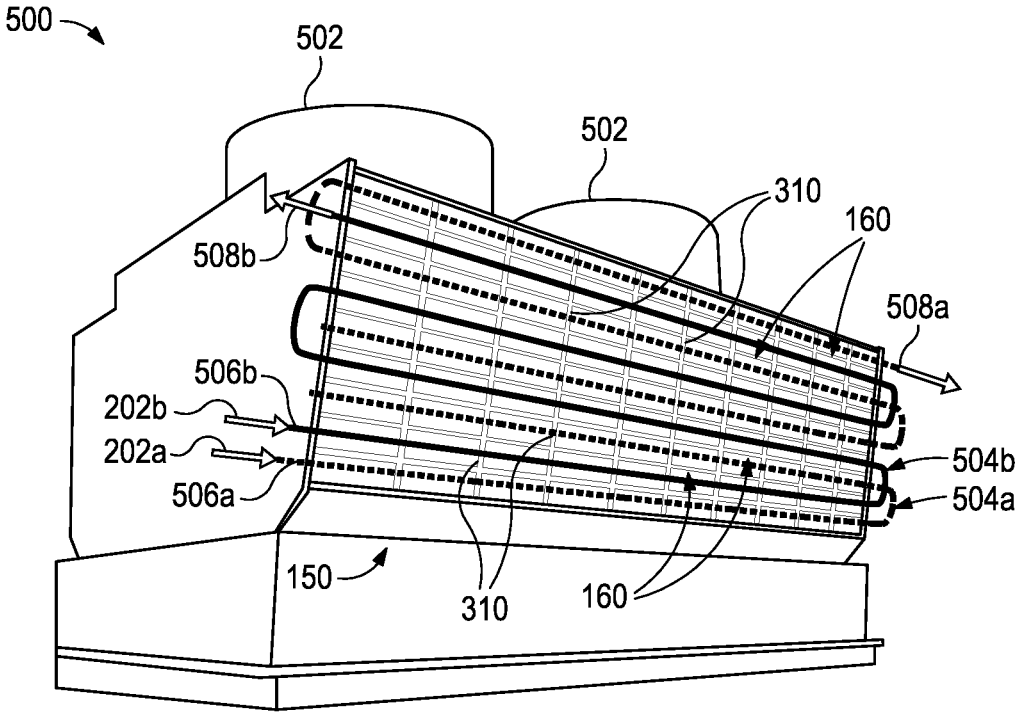
FIG. 5 is a block diagram of an example cooling system that may incorporate the principles of the present disclosure.

FIG. 5 is a schematic, isometric view of an example cooling system 500 that may incorporate the principles of the present disclosure. As illustrated, the cooling system 500 includes one or more cooling towers 502 (two shown), which may be the same as or similar to the cooling tower 100 of FIG. 1 and, therefore, may be best understood with reference thereto. The cooling system 500 may include various deployments of one or both of the cooling assemblies 200, 400 described above with reference to FIGS. 2 and 4, respectively.

As illustrated, the cooling tower(s) 502 include a plurality of vertical supports 310 that support a plurality of vertically-spaced louvers 160 arranged at the intake vent 150 of the cooling tower(s) 502. In some embodiments, one or more deployments of the cooling assembly 200 of FIG. 2 can be attached the bottom side of an upper louver 160, or alternatively to the top side of a bottom louver 160, as generally described above. In other embodiments, or in addition thereto, one or more deployments of the cooling assembly 400 of FIG. 4 can be arranged between vertically adjacent louvers 160, as also generally described above.

In the illustrated embodiment, the cooling system 500 includes two fluid circuits, shown as a first fluid circuit 504*a* and a second fluid circuit 504*b*. Each fluid circuit 504*a,b* may be representative of one or both of the cooling assemblies 200, 400 of FIGS. 2 and 4, respectively. Accordingly, each fluid circuit 504*a,b* may include one or more tubes 110 (FIGS. 2 and 4) configured to circulate a coolant, shown as a first coolant 202*a* circulated through the first fluid circuit 504*a*, and a second coolant 202*b* circulated through the second fluid circuit 504*b*. In some embodiments, the coolants 202*a,b* may be the same, but could alternatively be different, without departing from the scope of the disclosure. Accordingly, in some embodiments, vertically adjacent rows of louvers 160 can have the same or different coolants 202*a,b* circulating therethrough.

As illustrated, each fluid circuit 504*a,b* extends between vertically adjacent louvers 160 and progressively climbs the height of the cooling towers 502 in a zigzag pattern. The first fluid circuit 504*a* may include a first fluid inlet 506*a* where the first coolant 202*a* may be introduced, and a first fluid outlet 508*a* where the first coolant 202*a* may be discharged from the first fluid circuit 504*a*. Similarly, the second fluid circuit 504*b* may include a second fluid inlet 506*b* where the second coolant 202*b* may be introduced, and a second fluid outlet 508*b* where the second coolant 202*b* may be discharged from the second fluid circuit 504*b*.

In the illustrated embodiment, the fluid circuits 504*a,b* extend between vertically adjacent louvers 106, referred to herein as "rows," and transition vertically upward to every other row until reaching the top of the intake vent 150. More specifically, the first fluid circuit 504*a* extends along a first row of vertically adjacent louvers 160, and then transitions vertically upward to extend along a third row of vertically adjacent louvers 160, following which the first fluid circuit 504*a* transitions vertically upward to extend along a fifth row of vertically adjacent louvers 160, and so on until reaching the top of the intake vent 150 and being discharged from the first fluid circuit 504*a* at the first fluid outlet 508*a*. Similarly, the second fluid circuit 504*b* extends along a second row of vertically adjacent louvers 160, and then transitions vertically upward to extend along a fourth row of vertically adjacent louvers 160, following which the second fluid circuit 504*b* transitions vertically upward to extend along a sixth row of vertically adjacent louvers 160, and so on until reaching the top of the intake vent 150 and being discharged from the second fluid circuit 504*b* at the second fluid outlet 508*b*.

Thus, the first and second coolants 202*a,b* can alternate rows of vertically-adjacent louvers 160. In some examples, the first and second coolants 202*a,b* may be the same and therefore share a common source. In other examples, however, the first and second coolants 202*a,b* can be different and therefore provided from different sources. Similarly, the first and second coolants 202*a,b* may be discharged to the same or different locations, such as being recycled back through the corresponding fluid circuits 504*a,b*.

The first and second fluid circuits 504*a,b* can also alternate operations and otherwise be alternatingly operable. That is, in some embodiments, the first fluid circuit 504*a* can be activated (operated) to convey the first coolant 202*a* while the second fluid circuit 504*b* can be turned off to prevent circulation of the second coolant 202*b*. Because the coolant 202*a,b*, and therefore the tubes 110 (FIGS. 2 and 4) of the cooling assemblies 200, 400 (FIGS. 2 and 4), can reach below a freezing point of water (e.g., 0° C.), condensation of water vapor on the tubes 110 attached to the louvers 160 can freeze to form portions (sections) of ice. In the event that ice forms on the tubes 110 of either of the fluid circuits 504*a,b*, the corresponding fluid circuit 504*a,b* can be turned off to cease circulation of the coolant 202*a,b*, which allows the ice to melt or break. Moreover, when one fluid circuit 504*a,b* is turned off, the other fluid circuit 504*a,b* may be activated to maintain a desired wet bulb temperature within the interior of the cooling tower(s) 502. Accordingly, in at least one embodiment, the operation of the fluid circuits 504*a,b* may alternate to allow ice accumulation to melt or dissipate, while simultaneously maintaining the desired wet bulb temperature of the cooling tower(s) 502.

Figure 6:
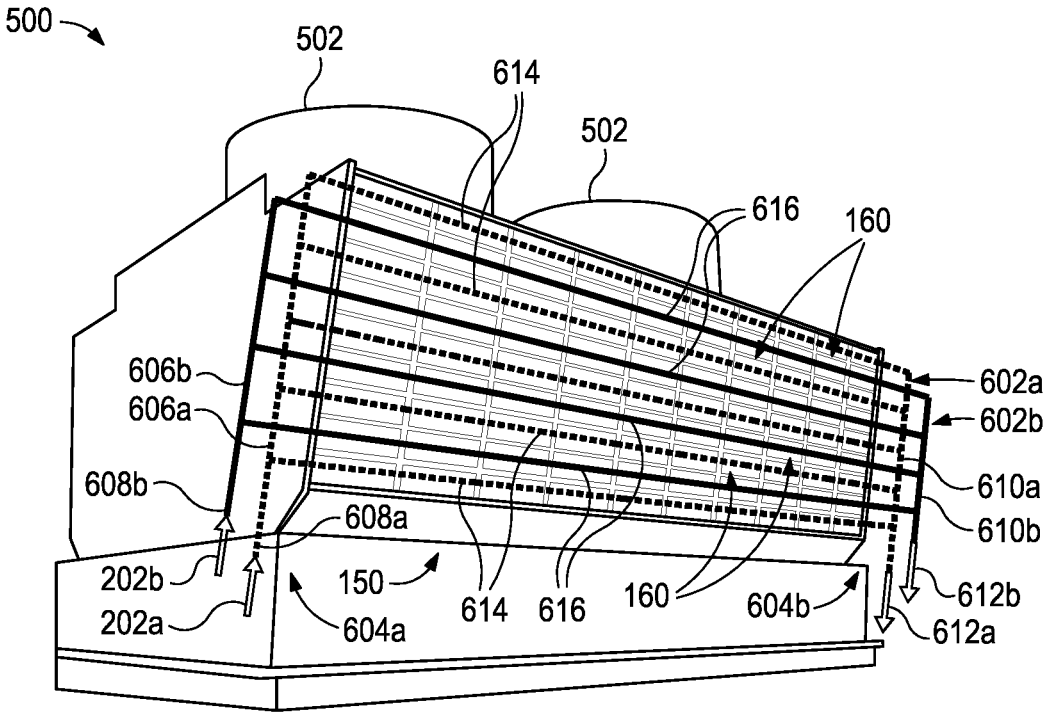
FIG. 6 is block diagram of another example cooling system that may incorporate the principles of the present disclosure.

FIG. 6 is a schematic, isometric view of another example cooling system 600 that may incorporate the principles of the present disclosure. The cooling system 600 may be similar in some respects to the cooling system 500 of FIG. 5, and therefore may be best understood with reference thereto, where like numerals represent like components not described again in detail. Similar to the cooling system 500, for example, the cooling system 600 includes the one or more cooling towers 502 (two shown). Moreover, the cooling system 600 may include various deployments of one or both of the cooling assemblies 200, 400 described above with reference to FIGS. 2 and 4, respectively.

Similar to the cooling system 500, the cooling system 600 includes two fluid circuits, shown as a first fluid circuit 602*a* and a second fluid circuit 602*b*. Each fluid circuit 602*a,b* has portions that extend between vertically adjacent louvers 160 and further between a first lateral side 604*a* of the intake vent 150 and a second lateral side 604*b* of the intake vent 150. At the first lateral side 604*a* of the intake vent 150, the first fluid circuit 602*a* includes a first intake manifold 606*a* that receives the first coolant 202*a* at a first fluid inlet 608*a*, and the second fluid circuit 602*b* includes a second intake manifold 606*b* that receives the second coolant 202*b* at a second fluid inlet 608*b*. At the second lateral side 604*b* of the intake vent 150, each fluid circuit 602*a,b* includes a corresponding discharge manifold 610*a* and 610*b*, respectively, that discharges the corresponding coolant 202*a,b* to corresponding first and second fluid outlets 612*a* and 612*b*, respectively.

The first fluid circuit 602*a* extends between the first intake and discharge manifolds 606*a*, 610*a* at multiple points along the height of the intake vent 150. In the illustrated example, the first fluid circuit 602*a* includes a plurality of independent conduits 614 that extend between the first intake and discharge manifolds 606*a*, 610*a* at every other row of vertically adjacent louvers 160. More specifically, the independent conduits 614 extend between the first intake and discharge manifolds 606*a*, 610*a* at the first, third, fifth, seventh, and ninth rows of vertically adjacent louvers 160. Similarly, the second fluid circuit 602*b* extends between the second intake and discharge manifolds 606*b*, 610*b* at multiple points along the height of the intake vent 150. In the illustrated example, the second fluid circuit 602*b* includes a plurality of independent conduits 616 that extend between the second intake and discharge manifolds 606*b*, 610*b* at every other row of vertically adjacent louvers 160. More specifically, the independent conduits 616 extend between the first intake and discharge manifolds 606*b*, 610*b* at the second, fourth, sixth, and eighth rows of vertically adjacent louvers 160. Therefore, circulation of the first and second coolants 202*a,b* between the first and second lateral sides 604*a,b* of the intake vent can alternate rows of vertically-adjacent louvers 160.

In some embodiments, the fluid circuits 602*a,b* may alternate operation. That is, when one fluid circuit 602*a,b* is operational, the other fluid circuit 602*a,b* may be deactivated. This may allow ice build-up on the tubes 210 (FIGS. 2 and 4) pertaining to the non-functional fluid circuit 602*a,b* to melt. It is also contemplated herein that the first and second intake manifolds 606*a,b* may be combined, thus circulating the same coolant 202*a,b* through the fluid circuits 602*a,b*. In such embodiments, the discharge manifolds 610*a,b* may also be combined. Moreover, while not shown, suitable valving and plumbing may be included in each fluid circuit 602*a,b* to help facilitate selective operation of the fluid circuits 602*a,b* as desired.

Figure 7:
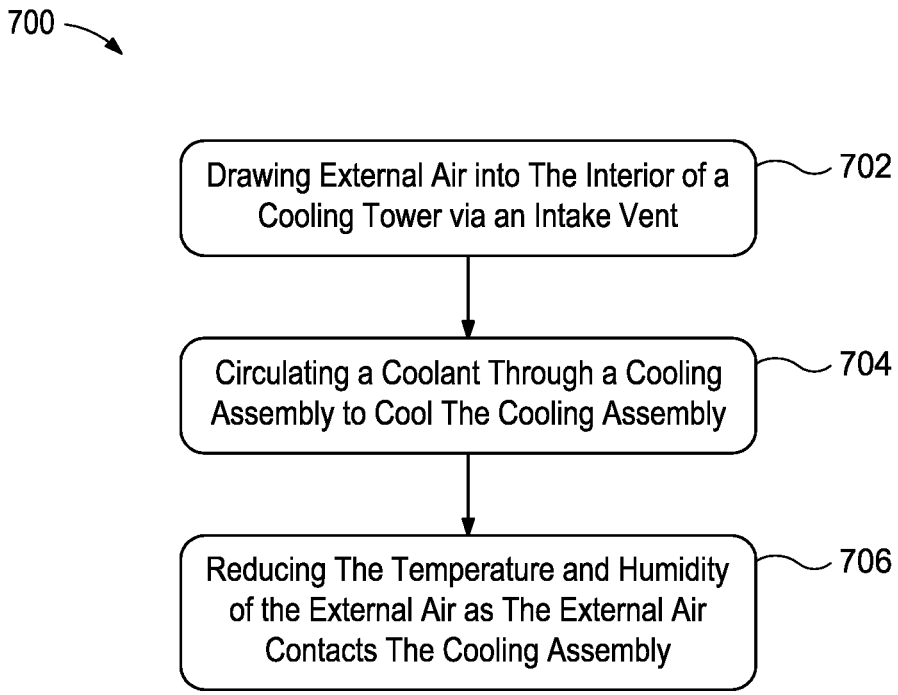
FIG. 7 is a flowchart of an example method for operating cooling systems.

FIG. 7 is a schematic flow chart of an example method 700 of enhancing cooling of a cooling tower, according to one or more embodiments. The method may include drawing external air into an interior of the cooling tower via an air intake vent, as at 702. The air intake vent may be provided on a sidewall of the cooling tower and include a plurality of louvers vertically offset from each other to direct the external air into the interior, and a cooling assembly attached to at least one of the plurality of louvers. The cooling assembly may include a tube and one or more fins extending from a surface of the tube.

The method 700 may further include circulating a coolant through the cooling assembly and thereby cooling the tube and the one or more fins, as at 704. While being drawn into the interior through the air intake vent, the temperature and the humidity of the external air may be reduced as the external air contacts the cooling assembly, as at 706.

In some embodiments, a wet bulb thermometer can measure the wet bulb temperature of the cooling tower, such as the wet bulb thermometer 148 of the cooling tower 100 of FIG. 1. A plurality of cooling assemblies, such as the cooling assemblies 200, 400 described herein can be attached to the louvers of the cooling tower to form first and second fluid circuits. A first coolant can be provided to cooling assemblies of the first fluid circuit, and the external air can be drawn into the cooling tower and pass over the cooling assemblies of the first fluid circuit. As a result, the temperature and humidity of the external air can be reduced by the cooling assemblies of the first fluid circuit. The wet bulb temperature of the cooling tower can then be measured again by the wet bulb thermometer 148. In some applications, a second wet bulb temperature may be less than the wet bulb temperature measured previously. In such applications, a second coolant can be provided to cooling assemblies of the second fluid circuit, and the external air drawn into the cooling tower will traverse and contact the cooling assemblies of the second fluid circuit. Consequently, the wet bulb temperature of the cooling tower can be further reduced with operation of the cooling assemblies of the second fluid circuit. In some applications ice can form over time on the louvers and/or cooling assemblies of the first fluid circuit in response to providing the first coolant to the first fluid circuit. In such applications, operation of the first fluid circuit may be deactivated such that the first coolant is prevented from flowing to the cooling assemblies of the first fluid circuit. This may allow the ice to melt or otherwise dissipate from the surfaces of the cooling assemblies of the first fluid circuit.

Embodiments disclosed herein include:

A. A cooling system, comprising a cooling tower providing a housing that has a bottom, a top opposite the bottom, and a sidewall extending between the top and the bottom; an air intake vent provided on the sidewall and through which external air can enter an interior of the cooling tower; a plurality of louvers arranged at the air intake vent and vertically offset from each other to direct the external air into the interior; and a cooling assembly attached to at least one of the plurality of louvers, the cooling assembly including a tube through which a coolant is circulated and one or more fins extending from a surface of the tube, wherein a temperature and a humidity of the external air is reduced as the external air contacts the cooling assembly while drawn into the interior through the air intake vent.

B. A cooling system, comprising an air intake vent provided on a sidewall of a cooling tower and through which external air enters an interior of the cooling tower, the air intake vent including a plurality of vertical supports; and a plurality of louvers supported on the plurality of vertical supports and vertically offset from each other, each pair of vertically offset louvers forming a corresponding row; and the cooling system further comprises a fluid circuit extending within at least one row and including one or more cooling assemblies attached to at least one of the vertically offset louvers, each cooling assembly including a tube through which a coolant is circulated and one or more fins extending from a surface of the tube, wherein a temperature and a humidity of the external air is reduced as the external air contacts the one or more cooling assemblies while drawn into the interior through the air intake vent.

C. A method of enhancing cooling of a cooling tower, comprising drawing external air into an interior of the cooling tower via an air intake vent provided on a sidewall of the cooling tower, the air intake vent including a plurality of louvers vertically offset from each other to direct the external air into the interior; and a cooling assembly attached to at least one of the plurality of louvers, the cooling assembly including a tube and one or more fins extending from a surface of the tube; the method further comprising circulating a coolant through the tube and thereby cooling the tube and the one or more fins; and reducing a temperature and a humidity of the external air as the external air contacts the cooling assembly while drawn into the interior through the air intake vent.

Each of embodiments A, B, and C may have one or more of the following additional elements in any combination: Element 1: wherein the coolant is selected from the group consisting of liquid nitrogen, liquefied natural gas, propane, butane, ethane, carbon dioxide, and any combination thereof. Element 2: wherein the tube and the one or more fins are made of a material selected from the group consisting of aluminum, copper, stainless steel, and any combination thereof. Element 3: wherein the cooling assembly further includes a substrate to which the tube is mounted, the cooling assembly being secured to the at least one of the plurality of louvers by attaching the substrate to the at least one of the plurality of louvers. Element 4: wherein at least one of the one or more fins comprises a semi-circular fin that extends about at least a portion of the tube. Element 5: wherein the one or more fins comprises a plurality of array fins arranged in series along a length of the tube.

Element 6: wherein the plurality of louvers includes an upper louver vertically offset from a lower louver, and the tube comprises a plurality of tubes through which the coolant is circulated, the cooling assembly further comprising an upper substrate attachable to a bottom of the upper louver; and a lower substrate attachable to a top of the lower louver, wherein the one or more fins extend between the upper and lower substrates and the plurality of tubes penetrate the one or more fins. Element 7: wherein the coolant comprises a first coolant circulated through a first tube of the plurality of tubes and a second coolant circulated through a second tube of the plurality of tubes, and wherein the first and second coolants are different. Element 8: wherein the first coolant is circulated in the first tube in a first direction, and the second coolant is circulated in the second tube in a second direction opposite the first direction. Element 9: wherein the one or more fins circumscribe the plurality of tubes.

Element 10: wherein the fluid circuit comprises a first fluid circuit, the one or more cooling assemblies comprise one or more first cooling assemblies, and the plurality of louvers provides a first set of rows alternately arranged with a second set of rows, the first fluid circuit extending along the first set of rows and the cooling system further comprising a second fluid circuit extending along the second set of rows and including one or more second cooling assemblies. Element 11: wherein the coolant comprises a first coolant circulated in the first fluid circuit, and a second coolant circulated in the second fluid circuit and different from the first coolant. Element 12: further comprising first and second intake manifolds arranged at a first lateral side of the intake vent; first and second discharge manifolds arranged at a second lateral side of the intake vent opposite the first lateral side; a first plurality independent conduits forming part of the first fluid circuit and extending between the first intake and discharge manifolds; and a second plurality independent conduits forming part of the second fluid circuit and extending between the second intake and discharge manifolds. Element 13: wherein the first and second fluid circuits are alternatingly operable.

Element 14: wherein the coolant comprises a second coolant and the cooling assembly comprises one or more first cooling assemblies forming part of a first fluid circuit extending between a first set of vertically offset louvers of the plurality of louvers, the air intake vent further including one or more second cooling assemblies forming part of a second fluid circuit extending between a second set of vertically offset louvers of the plurality of louvers, the method further comprising circulating the first coolant through the first fluid circuit; circulating a second coolant through the second fluid circuit; and reducing the temperature and the humidity of the external air as the external air contacts the one or more first and second cooling assemblies while drawn into the interior through the air intake vent. Element 15: further comprising conveying the first coolant into a first intake manifold arranged at a first lateral side of the intake vent; conveying the second coolant into a second intake manifold arranged at the first lateral side of the intake vent; receiving the first coolant at a first discharge manifold arranged at a second lateral side of the intake vent opposite the first lateral side; and receiving the second coolant at a second discharge manifold arranged at the second lateral side.

Element 16: further comprising: circulating the first coolant from the first intake manifold to the first discharge manifold via a first plurality independent conduits forming part of the first fluid circuit and extending between the first intake and discharge manifolds; and circulating the second coolant from the second intake manifold to the second discharge manifold via a second plurality independent conduits forming part of the second fluid circuit and extending between the second intake and discharge manifolds. Element 17: further comprising alternating operation of the first and second fluid circuits.

By way of non-limiting example, exemplary combinations applicable to A, B, and C include: Element 6 with Element 7; Element 6 with Element 9; Element 7 with Element 9; Element 10 with Element 11; Element 10 with Element 12; Element 10 with Element 13; Element 14 with Element 15; Element 14 with Element 17; and Element 15 with Element 16.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A cooling system, comprising:

a cooling tower providing a housing that has a bottom, a top opposite the bottom, and a sidewall extending between the top and the bottom;

an air intake vent provided on the sidewall and through which external air can enter an interior of the cooling tower;

a plurality of louvers arranged at the air intake vent and vertically offset from each other to direct the external air into the interior, each louver including an upper louver vertically offset from a lower louver; and a cooling assembly attached to at least one of the plurality of louvers, the cooling assembly including:

a plurality of tubes through which a coolant is circulated;

an upper substrate attachable to a bottom of the upper louver;

a lower substrate attachable to a top of the lower louver; and one or more fins extending between the upper and lower substrates, wherein the plurality of tubes penetrate the one or more fins, and wherein a temperature and a humidity of the external air is reduced as the external air contacts the cooling assembly while drawn into the interior through the air intake vent.

2. The cooling system of claim 1, wherein the coolant is selected from the group consisting of liquid nitrogen, liquefied natural gas, propane, butane, ethane, carbon dioxide, and any combination thereof.

3. The cooling system of claim 1, wherein the tube and the one or more fins are made of a material selected from the group consisting of aluminum, copper, stainless steel, and any combination thereof.

4. The cooling system of claim 1, wherein the cooling assembly further includes a substrate to which the tube is mounted, the cooling assembly being secured to the at least one of the plurality of louvers by attaching the substrate to the at least one of the plurality of louvers.

5. The cooling system of claim 1, wherein at least one of the one or more fins comprises a semi-circular fin that extends about at least a portion of the tube.

6. The cooling system of claim 1, wherein the one or more fins comprises a plurality of array fins arranged in series along a length of the tube.

7. The cooling system of claim 1, wherein the coolant comprises a first coolant circulated through a first tube of the plurality of tubes and a second coolant circulated through a second tube of the plurality of tubes, and wherein the first and second coolants are different.

8. The cooling system of claim 7, wherein the first coolant is circulated in the first tube in a first direction, and the second coolant is circulated in the second tube in a second direction opposite the first direction.

9. The cooling system of claim 7, wherein the one or more fins circumscribe the plurality of tubes.

10. A cooling system, comprising:

an air intake vent provided on a sidewall of a cooling tower and through which external air enters an interior of the cooling tower, the air intake vent including:

a plurality of vertical supports; and a plurality of louvers supported on the plurality of vertical supports and vertically offset from each other, each pair of vertically offset louvers forming a corresponding row; and a fluid circuit extending within at least one row and including one or more cooling assemblies attached to at least one of the vertically offset louvers, each cooling assembly including a tube through which a coolant is circulated and one or more fins extending from a surface of the tube, wherein a temperature and a humidity of the external air is reduced as the external air contacts the one or more cooling assemblies while drawn into the interior through the air intake vent.

11. The cooling system of claim 10, wherein the fluid circuit comprises a first fluid circuit, the one or more cooling assemblies comprise one or more first cooling assemblies, and the plurality of louvers provides a first set of rows alternately arranged with a second set of rows, the first fluid circuit extending along the first set of rows and the cooling system further comprising:

a second fluid circuit extending along the second set of rows and including one or more second cooling assemblies.

12. The cooling system of claim 10, wherein the coolant comprises a first coolant circulated in the first fluid circuit, and a second coolant circulated in the second fluid circuit and different from the first coolant.

13. The cooling system of claim 10, further comprising:

first and second intake manifolds arranged at a first lateral side of the intake vent;

first and second discharge manifolds arranged at a second lateral side of the intake vent opposite the first lateral side;

a first plurality independent conduits forming part of the first fluid circuit and extending between the first intake and discharge manifolds; and a second plurality independent conduits forming part of the second fluid circuit and extending between the second intake and discharge manifolds.

14. The cooling system of claim 10, wherein the first and second fluid circuits are alternatingly operable.

15. A method of enhancing cooling of a cooling tower, comprising:

drawing external air into an interior of the cooling tower via an air intake vent provided on a sidewall of the cooling tower, the air intake vent including:

a plurality of louvers vertically offset from each other to direct the external air into the interior;

a first cooling assembly forming part of a first fluid circuit extending between a first set of vertically offset louvers of the plurality of louvers; and a second cooling assembly forming part of a second fluid circuit extending between a second set of vertically offset louvers of the plurality of louvers, each cooling assembly including a tube and one or more fins extending from a surface of the tube;

circulating a first coolant through the first fluid circuit;

circulating a second coolant through the second fluid circuit; and reducing a temperature and a humidity of the external air as the external air contacts the first or second cooling assemblies while drawn into the interior through the air intake vent.

16. The method of claim 15, further comprising:

conveying the first coolant into a first intake manifold arranged at a first lateral side of the intake vent;

conveying the second coolant into a second intake manifold arranged at the first lateral side of the intake vent;

receiving the first coolant at a first discharge manifold arranged at a second lateral side of the intake vent opposite the first lateral side; and receiving the second coolant at a second discharge manifold arranged at the second lateral side.

17. The method of claim 16, further comprising:

circulating the first coolant from the first intake manifold to the first discharge manifold via a first plurality independent conduits forming part of the first fluid circuit and extending between the first intake and discharge manifolds; and circulating the second coolant from the second intake manifold to the second discharge manifold via a second plurality independent conduits forming part of the second fluid circuit and extending between the second intake and discharge manifolds.

18. The method of claim 15, further comprising alternating operation of the first and second fluid circuits.

* * * * *